US009583042B2

(12) United States Patent
Sung et al.

(10) Patent No.: US 9,583,042 B2
(45) Date of Patent: Feb. 28, 2017

(54) DISPLAY DEVICE HAVING A POWER PROVIDING LINE

(71) Applicant: Samsung Display Co., Ltd., Yongin-si, Gyeonggi-do (KR)

(72) Inventors: Si-Duk Sung, Hwaseong-si (KR); Sang Myeon Han, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/826,077

(22) Filed: Aug. 13, 2015

(65) Prior Publication Data

US 2015/0348465 A1 Dec. 3, 2015

Related U.S. Application Data

(62) Division of application No. 13/182,271, filed on Jul. 13, 2011, now Pat. No. 9,129,560.

(30) Foreign Application Priority Data

Aug. 26, 2010 (KR) ..... 10-2010-0083053

(51) Int. Cl.
*G09G 3/30* (2006.01)
*G09G 3/32* (2016.01)

(52) U.S. Cl.
CPC ..... *G09G 3/3258* (2013.01); *G09G 3/3233* (2013.01); *G09G 2320/0223* (2013.01); *G09G 2330/02* (2013.01); *G09G 2330/025* (2013.01)

(58) Field of Classification Search
CPC .. G09G 3/30; G09G 3/36; G09G 3/34; G09G 3/10; G09F 9/30; H05B 33/00; H05B 33/02; H05B 33/12; H05B 33/14
See application file for complete search history.

(56) References Cited

U.S. PATENT DOCUMENTS 8,004,480 B2 * 8/2011 Kim ..... G09G 3/3291 345/76
2005/0236970 A1 * 10/2005 Matsudate ..... H01L 27/3244 313/500

(Continued)

FOREIGN PATENT DOCUMENTS

JP 2004-226543 8/2004
JP 2007-304598 11/2007

(Continued)

*Primary Examiner* — Pegeman Karimi
(74) *Attorney, Agent, or Firm* — Lewis Roca Rothgerber Christie LLP

(57) ABSTRACT

A display device includes: a display panel for displaying frames during an elapse of time; and an emission driver for providing first and second emission power sources to the display panel, wherein: each of the frames comprises a first light emitting period, a light non-emitting period and a second light emitting period according to a time sequence, a difference value between the first and second emission power sources is substantially equal to or greater than a reference value during the first and second light emitting periods, and is less than the reference value during the light non-emitting period, and the difference value between the first and second emission power sources decreases over an elapse of time during the first light emitting period, and increases over an elapse of time during the second light emitting period.

4 Claims, 6 Drawing Sheets

(56) References Cited

U.S. PATENT DOCUMENTS

| | | | | |
|---|---|---|---|---|
| 2005/0237001 | A1 | 10/2005 | Hayafuji | |
| 2006/0220578 | A1* | 10/2006 | Park | G09G 3/3225 315/169.3 |
| 2007/0262931 | A1 | 11/2007 | Peng et al. | |
| 2008/0218448 | A1 | 9/2008 | Park et al. | |
| 2010/0110050 | A1 | 5/2010 | Park et al. | |
| 2010/0188391 | A1 | 7/2010 | Kim | |
| 2011/0025671 | A1* | 2/2011 | Lee | G09G 3/003 345/211 |
| 2011/0084958 | A1 | 4/2011 | Choi et al. | |

FOREIGN PATENT DOCUMENTS

| | | |
|---|---|---|
| JP | 2010-060975 | 3/2010 |
| KR | 10-2010-0053233 A | 5/2010 |
| KR | 10-2010-0087867 | 8/2010 |

* cited by examiner

DISPLAY DEVICE HAVING A POWER PROVIDING LINE

CROSS-REFERENCE TO RELATED APPLICATION(S)

This application is a divisional of U.S. patent application Ser. No. 13/182,271 filed Jul. 13, 2011, which claims priority to and the benefit of Korean Patent Application No. 10-2010-0083053, filed on Aug. 26, 2010, the entire content of both of which are incorporated fully herein by reference.

BACKGROUND

1. Field

The present invention relates to a display device.

2. Description of the Related Art

Recently, display devices such as monitors and televisions are becoming lighter and thinner. An Organic Light Emitting Diode (OLED) display is one such device that has been attracting much attention.

OLED displays include two electrodes, and an emission layer interposed therebetween. In OLED displays, electrons injected from one of the two electrodes and holes injected from the other electrode are combined in the emission layer to form excitons, and the excitons release energy to emit light. One of the electrodes is coupled to a thin film transistor for controlling the amount of light emitted from the emission layer.

Since OLED displays are self-emitting display devices, a current is supplied to the OLEDs of the OLED displays. As the OLED displays use a high amount of current, IR drop increases. Therefore, variations in brightness may occur in one frame, and thus much research is being conducted to address the issue of brightness variation.

SUMMARY

Embodiments of the present invention provide a display device having high reliability and a driving method thereof.

Embodiments of the present invention provide a display device having high reliability and a driving method thereof, which improves a brightness variation.

Embodiments of the present invention provide a display device including: a display panel for displaying frames during an elapse of time; and an emission driver for providing first and second emission power sources to the display panel, wherein: each of the frames comprises a first light emitting period, a light non-emitting period and a second light emitting period according to a time sequence, a difference value between the first and second emission power sources is substantially equal to or greater than a reference value during the first and second light emitting periods, and is less than the reference value during the light non-emitting period, and the difference value between the first and second emission power sources decreases over an elapse of time during the first light emitting period, and increases over an elapse of time during the second light emitting period.

A variation in the difference value between the first and second emission power sources may be about 0.5 V to 3.5 V.

The second emission power source may be maintained at a substantially constant value that is less than that of the first emission power source, the first emission power source may have a first level during the first and second light emitting periods and a second level during the light non-emitting period, the first level being higher than the second level, and the first level may decrease from a first voltage value to a second voltage value during the first light emitting period.

The first voltage value may be a maximum value of the first level, and the second voltage value may be a minimum value of the first level.

The first level may have the first voltage value at a starting point of the first light emitting period, and may have the second voltage value at an end point of the first light emitting period.

The first level may increase from the second voltage value to the first voltage value over an elapse of time, during the second light emitting period.

The first level may have the second voltage value at a starting point of the second light emitting period, and may have the first voltage value at an end point of the second light emitting period.

The first emission power source may be maintained at a substantially constant value higher than the second emission power source, the second emission power source may have a first level during the light non-emitting period and a second level during the first and second light emitting periods, the first level being higher than the second level, and the second level may increase from a third voltage value to a fourth voltage value during the first light emitting period, and may decrease from the fourth voltage value to the third voltage value during the second light emitting period.

The third voltage value may be a minimum value of the second level, and the fourth voltage value may be a maximum value of the second level.

The second level may have the third voltage value at a starting point of the first light emitting period and an end point of the second light emitting period, and may have the fourth voltage value at an end point of the first light emitting period and a starting point of the second light emitting period.

According to another embodiment of the present invention, a display device includes: a display panel for displaying frames during an elapse of time; and an emission driver for providing first and second emission power sources to the display panel, wherein: each of the frames comprises a light emitting period where a difference value between the first and second emission power sources is substantially equal to or greater than a reference value, and the difference value between the first and second emission power sources changes over an elapse of time, during the light emitting period.

The difference value between the first and second emission power sources may decrease during the light emitting period.

The difference value between the first and second emission power sources may have a maximum value at a starting point of the light emitting period.

Each of the frames may further include a light non-emitting period following the light emitting period, and the difference value between the first and second emission power sources may be less than the reference value during the light non-emitting period.

Each of the frames may further include an additional light emitting period following the light non-emitting period, and during the additional light emitting period, the difference value between the first and second emission power sources may be equal to or greater than the reference value and may increase over an elapse of time.

The difference value between the first and second emission power sources may have a maximum value at an end point of the additional light emitting period.

The display panel may further include a timing controller for generating an emission control signal, wherein the emission driver is configured to provide the first and second emission power sources to the display panel in response to the emission control signal.

According to another embodiment of the present invention, a display device includes: a display panel comprising a plurality of pixels; and an emission driver for providing an emission power source to the display panel, wherein: the display panel comprises first and second sections arranged in a first direction, the display panel comprises a power providing line for providing the emission power source to the pixels and extended in the first direction, and the power providing line comprises a first part in the first section, and a second part in the second section having a width different from a width of the first part.

The width of the first part may be broader than the width of the second part.

The display panel may further include a third section, the second section may be between the first and third sections, and the power providing line may be in the third section and may include a third part having substantially the same width as the width of the first part.

BRIEF DESCRIPTION OF THE DRAWINGS

The accompanying drawings are included to provide a further understanding of embodiments of the present invention, and are incorporated in and constitute a part of this application. The drawings illustrate exemplary embodiments of the present invention and, together with the description, serve to explain principles of the present invention. In the drawings.

DETAILED DESCRIPTION

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art.

Figure 1:
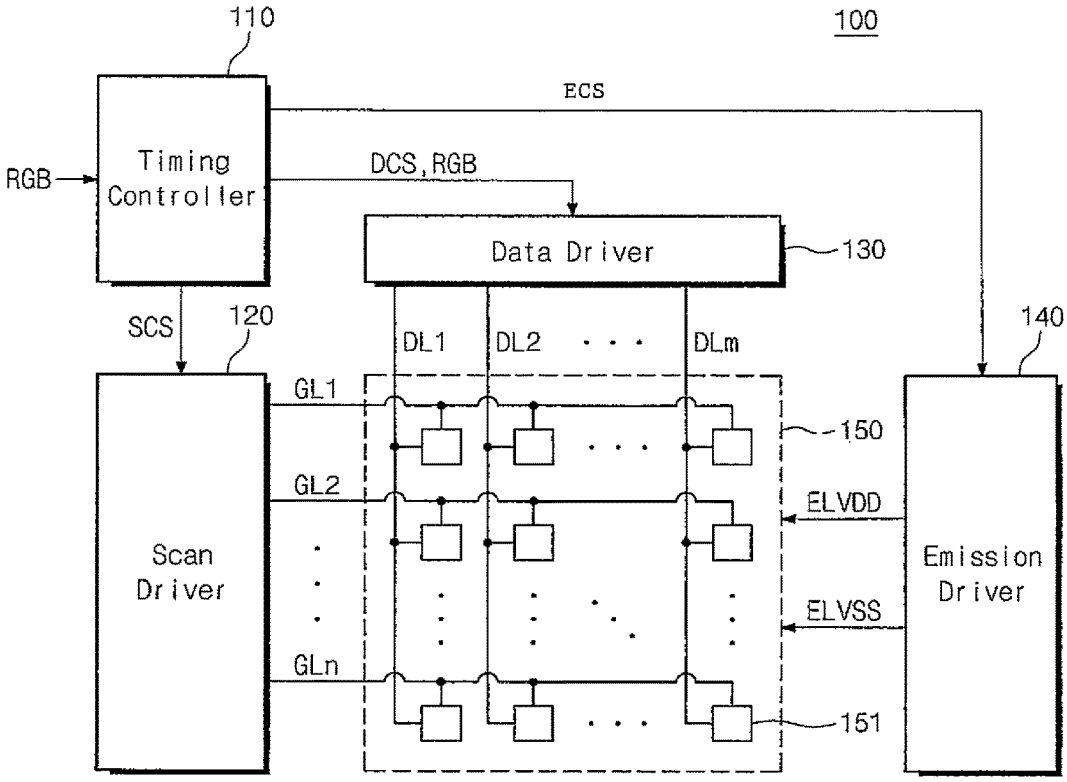
FIG. 1 is a block diagram illustrating a display device according to an embodiment of the present invention.

A display device according to an embodiment of the present invention will be described below. FIG. 1 is a block diagram illustrating a display device according to an embodiment of the present invention.

Referring to FIG. 1, a display device 100 according to an embodiment of the present invention includes a timing controller 110, a scan driver 120, a data driver 130, an emission driver 140, and a display panel 150.

The timing controller 110 may generate a scan control signal SCS, a data control signal DCS, and an emission control signal ECS. The timing controller 110 may transfer the scan control signal SCS to the scan driver 120, transfer the data control signal DCS to the data driver 130, and transfer the emission control signal ECS to the emission driver 140. The timing controller 110 may receive pixel data signals RGB and transfer the pixel data signals RGB to the data driver 130.

The scan driver 120 may receive the scan control signal SCS, select any one of a plurality of gate lines GL1 to GLn, and apply a gate voltage to the selected gate line. The scan driver 120 may control timing of the gate voltage supplied to the gate lines GL1 to GLn, in response to the scan control signal SCS.

For example, the scan driver 120 may sequentially apply the gate voltage from the first gate line GL1 through the nth gate line GLn. Switching transistors that are respectively included in pixel cells (e.g., pixels) connected to the selected gate line that receives the gate voltage, may be turned on. Switching transistors that are respectively included in pixel cells connected to unselected gate lines that do not receive the gate voltage, may be turned off. Transistors that are respectively included in pixel cells connected to the same gate line may be concurrently (e.g., simultaneously) turned on/off. The scan driver 120 may be directly formed on a substrate on which the display panel 150 is formed.

The data driver 130 may receive the pixel data signals RGB and the data control signal DCS. The data driver 130 may convert gray scale-converted (e.g., gray level-converted) pixel data signals RGB into analog voltages and supply the analog voltages to data lines DL1 to DLm.

The emission driver 140 may supply a first emission power source ELVDD and a second emission power source ELVSS to the display panel 150. When a pixel cell 151 of the display panel 150 includes an OLED, the first emission power source ELVDD and the second emission power source ELVSS may be applied to an anode and a cathode of the OLED, respectively. In response to the emission control signal ECS, the emission driver 140 may control the timing of light emission by a pixel cell by providing the first emission power source ELVDD and the second emission power source ELVSS having a difference value between them that is greater than a reference value. When the difference value between the first emission power source ELVDD and the second emission power source ELVSS is equal to or greater than the reference value, the OLED may emit light.

The display panel 150 may be an organic light emitting display panel including OLEDs. The display panel 150 may include the gate lines GL1 to GLn extended in a first direction, the data lines DL to DLm extended in a second direction, and a plurality of pixel cells (e.g., pixels) 151. Each of the pixel cells 151 may be connected to one gate line and one data line. A plurality of pixel cells 151 extended in the first direction may configure a row, and a plurality of pixel cells 151 extended in the second direction may configure a column. The pixel cells 151 included in the same row may be connected to the same gate line, and the pixel cells 151 included in the same column may be connected to the same data line. The gate lines GL1 to GLn may be extended between adjacent rows, and the data lines DL1 to DLm may be extended between adjacent columns. The pixel cells 151 will be described below in detail with reference to FIG. 2.

Figure 2:
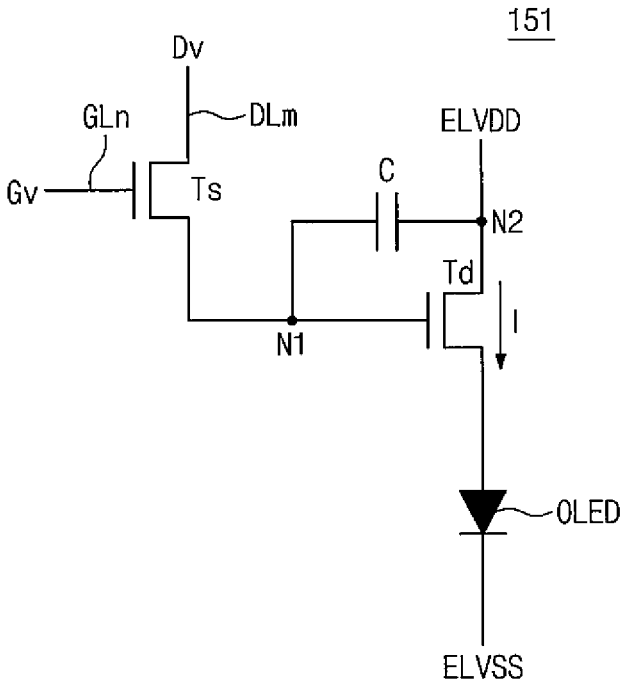
FIG. 2 is a circuit diagram exemplarily illustrating a pixel cell (or pixel circuit) of the display panel illustrated in FIG. 1.

FIG. 2 is a circuit diagram exemplarily illustrating one of the pixel cells 151 of the display panel 150 of FIG. 1. For conciseness, a pixel cell connected to an nth gate line GLn and an mth data line DLm is illustrated.

Referring to FIG. 2, each of the pixel cells 151 may include a switching device, a storage device, and a light emitting device. The switching device may include a switching transistor Ts and a driving transistor Td. The storage device may be a capacitor C, and the light emitting device may be an OLED.

The OLED may include an anode electrode, a cathode electrode, and an organic phosphor layer between the anode electrode and the cathode electrode. The organic phosphor layer may include a Hole Injection Layer (HIL), a Hole Transport Layer (HTL), an Emission Layer (EML), an Electron Transport Layer (ETL), and an Electron Injection Layer (EIL). The hole injection layer may be disposed to be adjacent to the anode electrode, and the electron injection layer may be disposed to be adjacent to the cathode electrode. Holes supplied through the hole injection layer and the hole transport layer recombine in the emission layer with electrons supplied through the electron injection layer and the electron transport layer, and thus the OLED may emit light.

The gate lines GL1 to GLn may apply a gate voltage Gv, which is supplied from the scan driver 120, to the pixel cells 151. The data lines DL1 to DLm may apply a data output voltage Ov, which is supplied from the data driver 120, to the pixel cells 151.

The switching transistor Ts may be connected between the data line DLm and a first node N1. The switching transistor Ts may be turned on by the gate voltage Gv applied through the gate line GLn and transfer the data output voltage Dv applied through the data line Olm to the first node N1. The data output voltage Dv transferred to the first node N1 may be stored in the storage capacitor C connected between the first node N1 and a second node N2.

The driving transistor Td may be turned on by the data output voltage Dv transferred to the first node N1. When the driving transistor Td is turned on and a voltage difference between the first and second emission power sources ELVDD and ELVSS is equal to or greater than a reference value, a driving current I may be applied to an OLED. When the driving current I is applied to the OLED, the OLED may emit light. The first emission power source ELVDD may be a voltage having a level higher than the second emission power source ELVSS. The first emission power source ELVDD may be applied to the anode of the OLED, and the second emission power source ELVSS may be applied to the cathode of the OLED.

The intensity of the driving current I may be determined by the data output voltage Dv applied to the driving transistor Td. The brightness of the OLED may be proportional to the intensity of the driving current I. Accordingly, the brightness of the OLED may be determined by the data output voltage Dv.

The second emission power source ELVSS may be substantially constant, and the first emission power source ELVDD may be a pulse voltage whose timing is controlled by the emission control signal ECS. Respective frames, which are displayed according to the difference value between the first emission power source ELVDD and the second emission power source ELVSS, may include a light emitting period and a light non-emitting period. This will be described below in detail with reference to FIG. 3.

Figure 3:
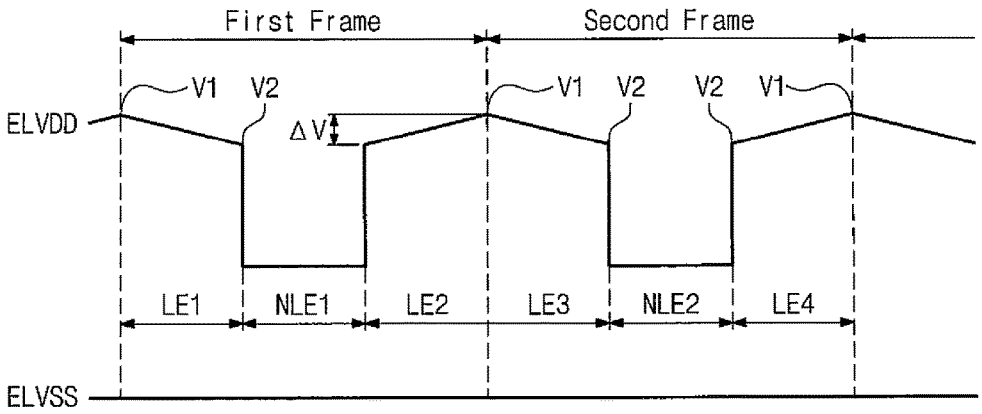
FIG. 3 is a timing diagram illustrating a light emitting and light non-emitting operation of the display device of FIG. 1.

FIG. 3 is a timing diagram illustrating a light emitting and light non-emitting operation of the display device of FIG. 1.

Referring to FIG. 3, the voltage of the first emission power source ELVDD varies (e.g., swings), and the voltage of the second emission power source ELVSS has a substantially constant value that is less than the voltage of the first emission power source ELVDD. Thus, one frame may include light emitting periods and light non-emitting periods.

The first emission power source ELVDD may have a pulse voltage having a high level and a low level. When the voltage of the first emission power source ELVDD has a high level, the first emission power source ELVDD and the second emission power source ELVSS have a difference value greater than the reference value, and thus the OLED (see FIG. 2) may emit light. On the other hand, when the first emission power source ELVDD has a low level, the first emission power source ELVDD and the second emission power source ELVSS have a difference value that may be less than the reference value, and thus the OLED (see FIG. 2) may not emit light.

A first frame may include a first light emitting period LE1, a first light non-emitting period NLE1 and a second light emitting period LE2 within a cycle of the pulse voltage of the first emission power source ELVDD, according to a time sequence (e.g., a time order). A second frame may include a third light emitting period LE3, a second light non-emitting period NLE2, and a fourth light emitting period LE4 within a cycle of the pulse voltage of the first emission power source ELVDD, according to a time sequence (e.g., a time order).

When the display device according to an embodiment of the present invention displays (or realizes) a Three-Dimensional (3D) image, left-eye image data may be displayed in the first light emitting period LE1 of the first frame and in the fourth light emitting period LE4 of the second frame, and right-eye image data may be displayed in the second light emitting period LE2 of the first frame and in the third light emitting period LE3 of the second frame.

In the light emitting periods LE1 to LE4, the difference value between the first and second emission power sources ELVDD and ELVSS may vary. That is, the difference value between the first and second emission power sources ELVDD and ELVSS applied to the OLED (see FIG. 2) may vary in the light emitting periods LE1 through LE4.

The difference value between the first and second emission power sources ELVDD and ELVSS may decrease over (or with) an elapse of time during the first light emitting period LE1. For example, the high level of the first emission power source ELVDD may decrease from a first voltage value V1 to a second voltage value V2 during the first light emitting period LE1.

The difference value between the first and second emission power sources ELVDD and ELVSS may increase over (or with) an elapse of time during the second light emitting period LE2. For example, the high level of the first emission power source ELVDD may increase from the second voltage value V2 to the first voltage value V1 during the second light emitting period LE2.

A difference (ΔV) between the first and second voltage values V1 and V2 may be about 0.5 V to 3.5 V. The first voltage value V1 may be the maximum voltage value of the first emission power source ELVDD. The second voltage value V2 may be the minimum voltage value of the high level of the first emission power source ELVDD.

The first emission power source ELVDD may have the first voltage value V1 at the starting point and end point of the first frame. Specifically, the first emission power source ELVDD may have the first voltage value V1 at the starting point of the first light emitting period LE1, and it may have the second voltage value V2 at the end point of the first light emitting period LE1 by decreasing over (or with) an elapse of time. The first emission power source ELVDD may have the second voltage value V2 at the starting point of the second light emitting period LE2, and it may have the first voltage value V1 at the end point of the second light emitting period LE2 by increasing over (or with) an elapse of time.

The high level of the first emission power source ELVDD may start from the second voltage, increase to the first voltage, and again decrease to the second voltage, over (or with) an elapse of time. The high level of the first emission power source ELVDD may have the first voltage value V1 at a time when the first frame is changed to the second frame or before/after that time.

In one embodiment, during the first and third light emitting periods LE1 and LE3, the power consumption of the display panel 150 (see FIG. 1) is at a maximum at the starting points of the first and third light emitting periods LE 1 and LE3, and it may decrease over (or with) an elapse of time. During the second and fourth light emitting periods LE2 and LE4, the power consumption is at a minimum at the starting points of the second and fourth light emitting periods LE2 and LE4, and it may increase over (or with) an elapse of time. That is, the power consumption may be at a maximum at the starting points and end points of the respective frames. As the power consumption increases, an amount of consumption current increases, and thus IR drop may increase. Therefore, IR drop over time may change in one frame. This will be described below with reference to FIG. 4.

Figure 4:
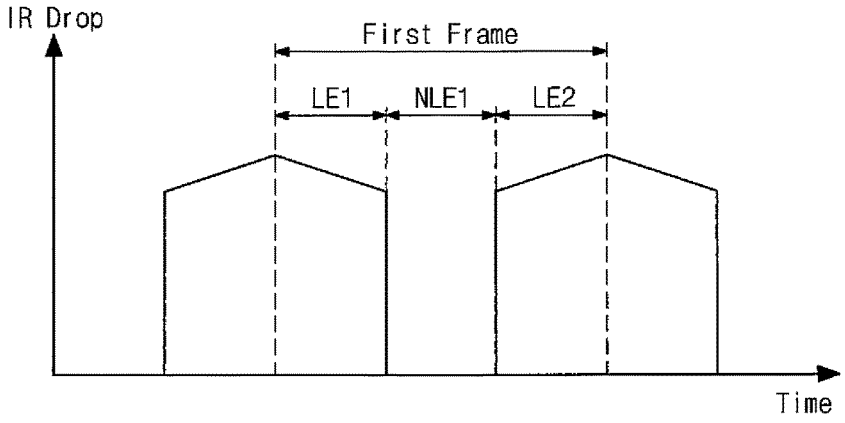
FIG. 4 is a graph showing IR drop over time in a first frame.

FIG. 4 is a graph showing IR drop over time in the first frame.

Referring to FIG. 4, as described above, an amount of current consumption may have a maximum value at the starting point and end point of the first frame. Therefore, IR drop may have a maximum value at the starting point of the first light emitting period LE1 of the first frame and decrease over (or with) an elapse of time. Also, IR drop may have a minimum value at the starting point of the second light emitting period LE2 of the first frame and increase over (or with) an elapse of time.

Referring again to FIG. 3, as described above, a difference in IR drop may occur in one frame, and IR drop may have a maximum value at the starting point of the first light emitting period LE1 of the first frame and at the end point of the second light emitting period LE2 of the first frame. According to an embodiment of the present invention, the first emission power source ELVDD may have the first voltage value V1 at the starting point of the first light emitting period LE1 of the first frame, and it may have the second voltage value V2 at the end point of the first light emitting period LE1 by decreasing over (or with) an elapse of time. Also, the first emission power source ELVDD may have the second voltage value V2 at the starting point of the second light emitting period LE2 of the first frame, and it may have the first voltage value V1 at the end point of the second light emitting period LE2 by increasing over (or with) an elapse of time.

The difference value between the first and second emission power sources ELVDD and ELVSS may increase/decrease in the first frame and have a maximum value at the starting point of the first light emitting period LE1 and the end point of the second light emitting period LE2. Therefore, although a difference in IR drop may occur in the first frame, a uniform emission power source can be applied to the pixel cells 151 (see FIG. 1) of the display panel 150 (see FIG. 1), and thus a Long Range Uniformity (LRU) of brightness can be improved. Accordingly, a display device having high reliability can be provided.

When the high level of the first emission power source ELVDD is maintained at a substantially constant voltage (e.g., the same voltage), the brightness of an upper image and the brightness of a lower image may be lower than the brightness of a center image due to IR drop, in one frame. According to an embodiment of the present invention, however, since the difference value between the first and second emission power sources ELVDD and ELVSS increases/decreases in one frame, IR drop can be moderated in one frame, and therefore a display device having high reliability can be implemented.

In the above-described embodiment of the present invention, the first emission power source ELVDD is applied as a pulse voltage, and the second emission power source ELVSS is substantially constant. On the other hand, the first emission power source ELVDD may be substantially constant, and the second emission power source ELVSS may be applied as a pulse voltage. This will be described below with reference to FIG. 5.

Figure 5:
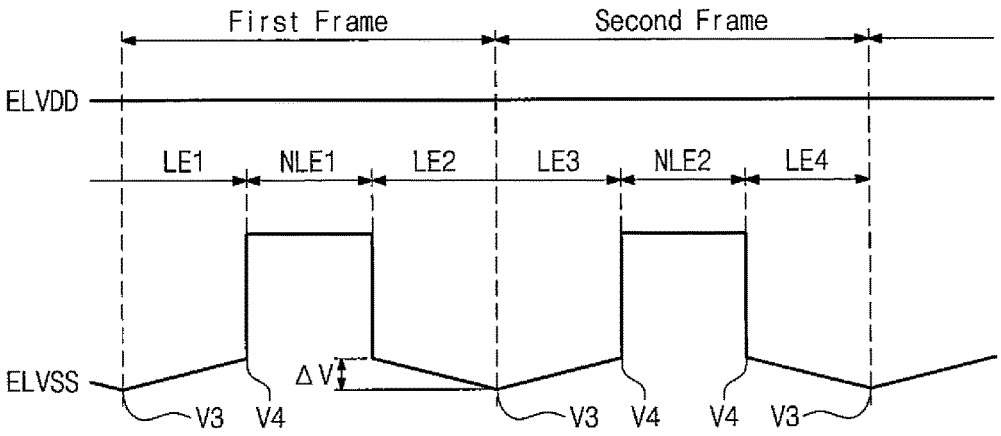
FIG. 5 is a timing diagram for describing a modified example of a light emitting and light non-emitting operation of the display device of FIG. 1.

FIG. 5 is a timing diagram for describing a modified example of a light emitting and light non-emitting operation of the display device of FIG. 1.

Referring to FIG. 5, the voltage of the second emission power source ELVSS varies (e.g., swings), and the voltage of the first emission power source ELVDD is maintained at a substantially constant value that is higher than the voltage of the second emission power source ELVSS. Thus, one frame may include a light emitting period and a light non-emitting period.

The second emission power source ELVSS may have a pulse voltage that has a high level and a low level. When the voltage of the second emission power source ELVSS has a low level, the difference value between the first and second emission power sources ELVDD and ELVSS may be equal to or greater than the reference value. On the other hand, when the second emission power source ELVSS has a high level, the difference between the first and second emission power sources ELVDD and ELVSS may be less than the reference value.

Periods where the second emission power source ELVSS is in a high-level state may include the light non-emitting period NLE1 of the first frame and the light non-emitting period NLE2 of the second frame, and periods where the second emission power source ELVSS is in a low-level state may include the light emitting periods LE 1 and LE2 of the first frame and the light emitting periods LE3 and LE4 of the second frame.

The difference value between the first and second emission power sources ELVDD and ELVSS may decrease over an elapse of time during the first light emitting period LE1. For example, the low level of the second emission power source ELVSS may increase from a third voltage value V3 to a fourth voltage value V4 during the first light emitting period LE1.

The difference value between the first and second emission power sources ELVDD and ELVSS may increase over (or with) an elapse of time during the second light emitting period LE2. For example, the low level of the second emission power source ELVSS may decrease from the fourth voltage value V4 to the third voltage value V3 during the second light emitting period LE2.

A difference (ΔV) between the third and fourth voltage values V3 and V4 may be about 0.5 V to 3.5 V. The third voltage value V3 may be the minimum voltage value (e.g., lowest level) of the second emission power source ELVSS. The fourth voltage value V4 may be the maximum voltage value (e.g., highest level) of the low level of the second emission power source ELVSS.

The second emission power source ELVSS may have the third voltage value V3 at the starting point and end point of the first frame. Specifically, the second emission power source ELVSS may have the third voltage value V3 at the starting point of the first light emitting period LE1, and it may have the fourth voltage value V4 at the end point of the first light emitting period LE1 by increasing over (or with) an elapse of time. The second emission power source ELVSS may have the fourth voltage value V4 at the starting point of the second light emitting period LE2, and it may have the third voltage value V3 at the end point of the second light emitting period LE2 by decreasing over (or with) an elapse of time.

A display device according to another embodiment of the present invention will be described below in detail.

Figure 6:
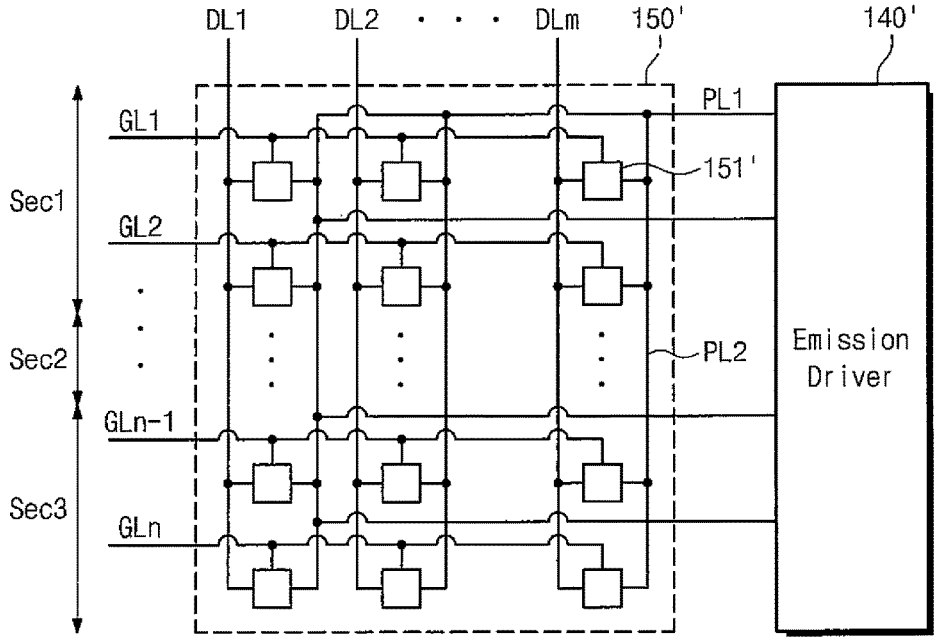
FIG. 6 is a block diagram illustrating a display panel of a display device according to another embodiment of the present invention.

FIG. 6 is a block diagram illustrating a display panel of a display device according to another embodiment of the present invention.

Referring to FIG. 6, a display panel 150' of a display device according to another embodiment of the present invention may be similar to the display panel 150 that has been described above with reference to FIG. 1. The display panel 150' may further include first power providing lines PL1 that are extended in the same direction as that of the gate lines GL1 to GLn, and second power providing lines PL2 that are extended in the same direction as that of the data lines DL1 to DLm.

Cross portions between the first power providing lines PL1 and the second power providing lines PL2 may be electrically connected. The first power providing lines PL1 and the second power providing lines PL2 can provide an emission power source to the pixel cells (e.g., pixels) 151'.

The display panel 150' may include a first section Sec1, a second section Sec2, and a third section Sec3. The first section Sec1 may include pixels 151' configuring a plurality of rows adjacent to the first gate line GL1. The third section Sec3 may include pixels 151' configuring a plurality of rows adjacent to the nth gate line GLn. The second section Sec2 may be disposed between the first and third sections Sec1 and Sec3. The second section Sec2 may correspond to the center of the display panel 150', and the first and third sections Sec1 and Sec3 may correspond to the upper portion and lower portions of the display panel 150', respectively.

The widths of the second power providing lines PL2 may be varied (or changed) based on the second direction. This will be described below with reference to FIGS. 7 and 8.

Figure 7:
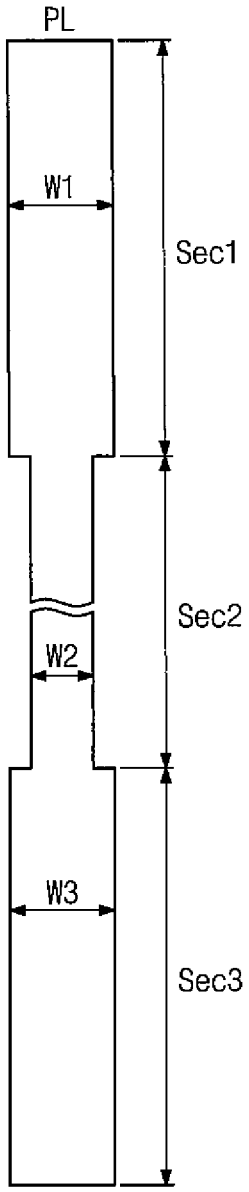
FIGS. 7 and 8 are exemplary diagrams for describing a power-providing line of a display panel according to another embodiment of the present invention.
Figure 8:
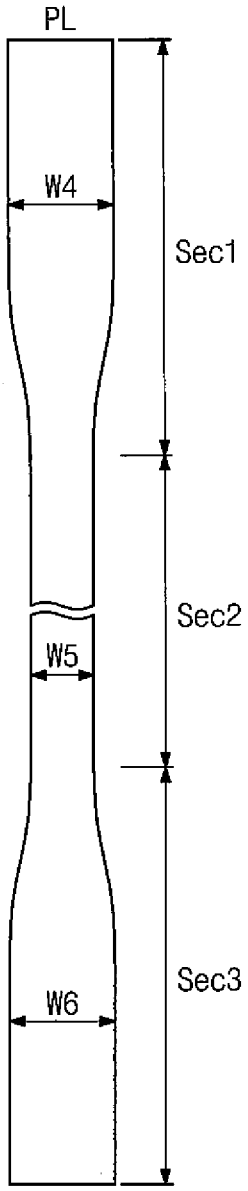

FIGS. 7 and 8 are exemplary diagrams for describing a power providing line of a display panel 150' according to another embodiment of the present invention.

Referring to FIGS. 7 and 8, the width of a power providing line PL may be varied (or changed) relative to (or based on) a direction in which the power providing line is extended. The power providing line PL may be the second power providing line PL2 that has been described above with reference to FIG. 6. The width of the power providing line PL may be varied (or changed) based on the first and third sections Sec1 and Sec3.

The power providing line PL may include a first part that provides an emission power source to the pixels of the first section Sec1, a second part that provides an emission power source to the pixels of the second section Sec2, and a third part that provides an emission power source to the pixels of the third section Sec3.

Referring to FIG. 7, the first part may have a first width W1, the second part may have a second width W2 narrower than the first width W1, and the third part may have a third width W3 broader than the second width W2. The first and third widths W1 and W3 may be substantially the same.

Referring to FIG. 8, the width of the first part of the power providing line PL may decrease at an end adjacent to the second part of the power providing line PL. For example, one end of the first part may have a maximum width W4, and the width of the first part may decrease gradually toward an end adjacent to the second part.

The width of the third part of the power providing line PL may decrease at an end adjacent to the second part of the power providing line PL. For example, one end of the third part may have a maximum width W5, and the width of the third part may decrease gradually toward an end adjacent to the second part.

In one embodiment, the second part may have a fifth width W5 narrower than the maximum width W4 of the first part and narrower than the maximum width W6 of the third part.

As the width of the power providing line PL becomes narrower, a resistance may increase. Therefore, an emission power source provided to the pixel cells of the second section Sec2 may have a power level lower than an emission power source that is provided to the pixel cells of the first and third sections Sec1 and Sec3. Accordingly, as described above with reference to FIGS. 3 and 4, even when IR drop varies (or changes) during one frame, a difference between emission power sources that are provided to the pixel cells of the sections Sec1 to Sec3 can be achieved (or can occur) by changing the width of the first power providing line PL1, and thus a display device that has high reliability and improves the LRU of brightness can be provided.

In another embodiment of the present invention that has been described above with reference to FIGS. 7 and 8, the display panel 150' can be divided into the first to third sections Sec1 to Sec3, but it is not limited thereto. For example, the display panel 150 may be divided into two sections or four or more sections. In this case, the widths of the power providing lines may be varied (or changed) based on the divided sections of the display panel 150'.

The display device according to embodiments of the present invention may include a timing controller that generates an emission control signal, and an emission driver for supplying first and second emission power sources to a display panel in response to the emission control signal. One frame may include a first light emitting period, a light non-emitting period and a second light emitting period, according to a time sequence (e.g., a time order), and a difference value between the first and second emission power sources may increase/decrease during the first and second light emitting periods. Therefore, the LRU of brightness can be improved in the one frame, and thus a display device having high reliability can be provided.

The above-disclosed subject matter is to be considered illustrative and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

An embodiment described and exemplified herein includes a complementary embodiment thereof. In the specification, the term 'and/or' is used to indicate that the term includes at least one of the preceding and succeeding elements. Like reference numerals refer to like elements throughout.

What is claimed is:

1. A display device comprising:

a display panel comprising a plurality of pixels; and an emission driver for providing an emission power source to the display panel, wherein:

the display panel comprises first and second sections arranged in a first direction, at least one pixel of the plurality of pixels is disposed in each of the first and second sections, the display panel comprises a power providing line for providing the emission power source to the pixels and extended in the first direction, and the power providing line comprises a first part in the first section, and a second part in the second section having a width different from a width of the first part, wherein the width of the second part in a direction away from the first part is substantially constant along the length of the second section.

2. The display device of claim 1, wherein the width of the first part is broader than the width of the second part.

3. The display device of claim 2, wherein:

the display panel further comprises a third section, the second section is between the first and third sections, and the power providing line is in the third section and comprises a third part having substantially the same width as the width of the first part.

4. The display device of claim 2, wherein:

the width of the first part decreases toward an end adjacent to the second part.

* * * * *